US007730621B2

(12) United States Patent
Komori et al.

(10) Patent No.: US 7,730,621 B2
(45) Date of Patent: Jun. 8, 2010

(54) SHAVING FOIL FOR A DRY SHAVER

(75) Inventors: Shunsuke Komori, Hikone (JP); Jyuzaemon Iwasaki, Nagahama (JP); Hiroaki Shimizu, Hikone (JP); Takeshi Shiba, Hikone (JP); Masaaki Sato, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 161 days.

(21) Appl. No.: 11/952,153

(22) Filed: Dec. 7, 2007

(65) Prior Publication Data

US 2008/0134523 A1 Jun. 12, 2008

(30) Foreign Application Priority Data

Dec. 8, 2006 (JP) ..... 2006-332434

(51) Int. Cl.
*B26B 19/04* (2006.01)

(52) U.S. Cl. ..... 30/346.51; 30/43.92; 30/346.61

(58) Field of Classification Search ..... 30/43, 30/43.91, 43.92, 345.61, 346.61, 346.51
See application file for complete search history.

(56) References Cited

U.S. PATENT DOCUMENTS 2,297,915 A * 10/1942 Rand, Jr. et al. ..... 30/34.2
3,602,991 A * 9/1971 Heinrich et al. ..... 30/346.51
5,185,926 A * 2/1993 Locke ..... 30/43.92
5,185,933 A 2/1993 Messinger
5,377,414 A * 1/1995 Buzzi et al. ..... 30/346.51
2004/0237318 A1 12/2004 Uchiyama

FOREIGN PATENT DOCUMENTS

| | | | |
|---|---|---|---|
| EP | 0 108 669 | A1 | 5/1984 |
| GB | 1090423 | A | 11/1967 |
| JP | 54-013789 | U | 1/1979 |
| JP | 59-151979 | A | 8/1984 |
| JP | 04-246396 | A | 9/1992 |
| JP | 2004-350824 | A | 12/2004 |

OTHER PUBLICATIONS

European Search Report for the Application No. EP 07 02 2798 dated Apr. 2, 2008.
Notification of Reasons for Refusal for the Application No. 2006-332434 from Japan Patent Office mailed Sep. 16, 2008.

* cited by examiner

*Primary Examiner*—Hwei-Siu C Payer
(74) *Attorney, Agent, or Firm*—Cheng Law Group, PLLC

(57) ABSTRACT

A shaving foil for a dry shaver has a plurality of perforation arranged in an array. The shaving foil is formed in its skin contact surface with a plurality of recesses which define a thin section of reduced thickness at the recesses, while leaving thick sections at the remainder of the foil. Each perforation is configured to have its circumference defined partly by the thin section and partly by the thick section. Both of the thin and thick sections can come into contact with a user's skin for smoothly guiding hairs into the perforations to make close shaving without irritating the skin, while the shaving foil is moved across the skin. Especially, the thin sections act to cut the hairs shorter than the thick section, as wall as to raise flattened hairs into the perforations for successfully cutting the flattened hairs.

8 Claims, 12 Drawing Sheets

SHAVING FOIL FOR A DRY SHAVER

TECHNICAL FIELD

The present invention is directed to a shaving foil for use in a dry shaver.

BACKGROUND ART

U.S. Pat. No. 5,185,933 discloses a shaving foil for a dry shaver which is configured to have protuberances on a skin engaging surface of the foil in order to raise flattened hairs for efficient shaving. However, since the protuberances are distributed separately from each other to give discrete knobs on the shaving foil, they are likely to drag a user's skin and is therefore not suitable for smoothly guiding the outer foil across the skin. It is generally known that the shaving foil of reduced-thickness is effective to make a close shaving of cutting relatively straight hairs, as well as to raise flattened hairs for effectively cutting such hairs. However, the use of the thin shaving foil is certainly accompanied with a drawback of seizing the skin too much into perforations of the foil and irritating the skin. Accordingly, it has been a demand of making the close shaving added with capability of cutting the flattened hairs, yet minimizing the skin irritation.

DISCLOSURE OF THE INVENTION

In view of the above problem, the present invention has been accomplished to provide a shaving foil for a dry shaver which is capable of assuring close shaving, yet without causing the skin irritation. For example, as shown in FIGS. 8 and 9, the shaving foil in accordance with the present invention has an array of perforations (32) and is configured to a plurality of recesses (140) formed in its top surface defining a skin contact surface to give a thin section (140) of reduced thickness at each of the recesses (140) and to leave thick sections (142) at the remainder of said foil. Each of the perforations (32) is configured to have its circumference defined partly by the thin section (140) and partly by the thick section (142). With this configuration, both of the thin and thick sections can come into contact with a user's skin for smoothly guiding hairs into the perforations to make close shaving without irritating the skin, while the shaving foil is moved across the skin, during which the thin sections act to cut the hairs shorter than the thick section, and to raise flattened hairs into the perforations for successfully cutting the flattened hairs as well.

Preferably, as shown in FIG. 9, the array is configured to include first adjacent pairs of the perforations (32*i*, 32*j*) arranged in a first direction (A), and second adjacent pairs of the perforations (32*j*, 32*k*) arranged in a second direction (B) different from the first direction (A). The thin section (140) is configured to extend between the perforations of the first adjacent pairs (32*i*, 32*j*) to have its top surface (140*ts*) leading to the peripheries of the perforations (32*i*, 32*j*) at opposite ends (Ei, Ej1) of the thin section (140) with respect to the first direction (A). The thick section (142) is also configured to extend between the perforations of the second adjacent pairs (32*j*, 32*k*) to have its top surface (142*ts*) leading to the peripheries of the perforations (32*j*, 32*k*) at opposite ends (Ej2, Ek) of the thick section (142) with respect to the second direction (B). Thus, the shaving foil is given a specific orientation in which the thin sections extend alternately with the perforations to make a closer shaving.

In this connection, the thick section (142) is configured to extend over two or more successive perforations (32*i*, 32*j*) arranged in the first direction (A). Thus, the thick section provides a top continuous surface for smooth sliding contact with the skin as well as for reinforcing the shaving foil.

As shown in FIGS. 10 and 11, the thin section (140) and thick section (142) are configured to extend to associated portions of the periphery of the perforation (32) to form thereat a first cutting edge (140*ce*) and a second cutting edge (142*ce*), respectively. It is preferred that the first cutting edge (140*ce*) is configured to have a cutting angle (β1) less than that (β2) of the second cutting edge (142*ce*) for improving the effect of raising the hairs guiding by the thin section.

As shown in FIGS. 8 and 9, the shaving foil is preferably elongated to have a lengthwise axis and to arrange the thin sections (140) along the first direction (A) which crosses with the lengthwise axis. With this structure, the shaving foil is given a direction-dependent characteristic which provides a close shaving when the shaving foil is moving relative to the user skin along its lengthwise axis, and provides a closer or deeper shaving when the shaving foil is moving along the first direction crossing the lengthwise axis of the elongated foil. In this instance, the thick section (142) is preferred to extend continuously over a full width of the foil along the first direction (A) to compensate for lowered mechanical strength due to the provision of the thin sections.

In a preferred embodiment, each of the perforations is shaped into a polygon having one side bridged to one of the adjacent perforations (32) through the thin section (140), and another side bridged to another of adjacent perforations (32) by means of the thick section (142).

The foil may be configured such that the thin sections (140) occupy a less area than the thick sections (142) for the purpose of keeping a sufficient mechanical strength Preferably, the thick section (142) is given a thickness of 50 μm to 80 μm, while the thin section (140) is given a thickness of 45 μm or less for satisfying practical requirements.

These and still other advantageous features of the present invention will become more apparent from the following description of the preferred embodiment when taken in conjunction with the attached drawings.

BEST MODE FOR CARRYING OUT THE INVENTION

Figure 1:
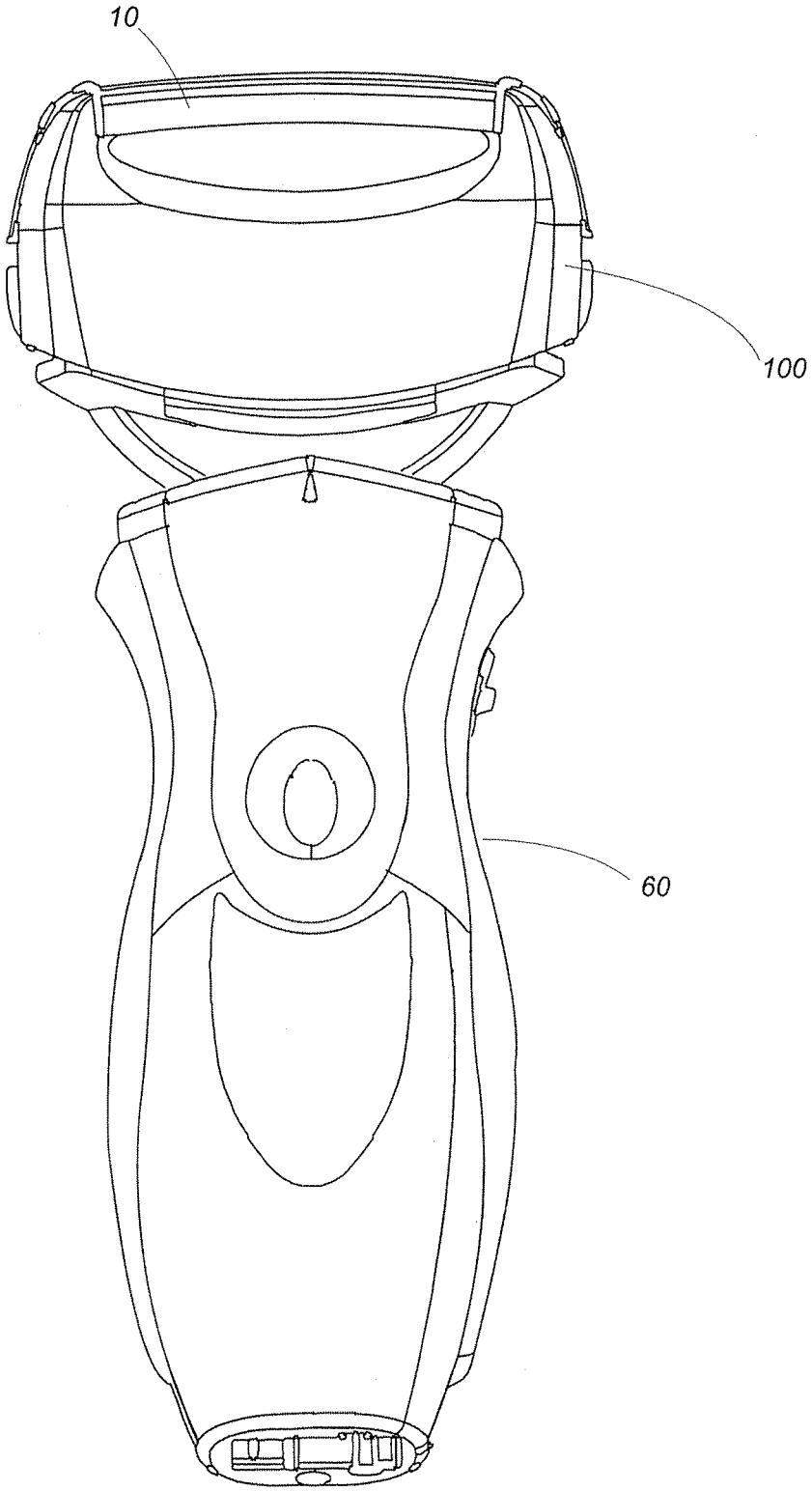
FIG. 1 is a front view of a dry shaver equipped with a shaving foil in accordance with a preferred embodiment of the present invention.
Figure 2:
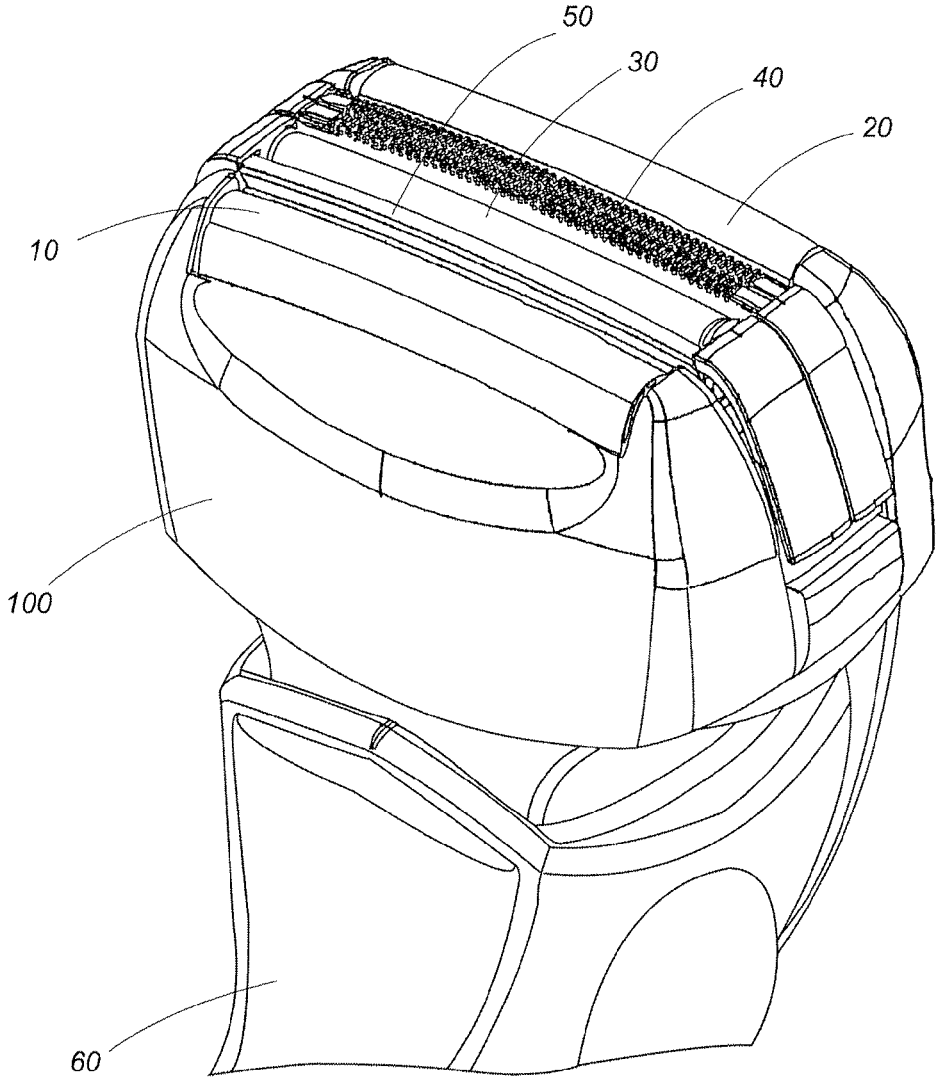
FIG. 2 is a perspective view of a shaving head of the above dry shaver.

Referring now to FIGS. 1 to 5, there is shown a dry shaver utilizing a shaving foil in accordance with a preferred embodiment of the present invention. The dry shaver is composed of a hand grip 60 and a shaving head 100 mounted on top of the hand grip 60. The shaving head 100, which is elongated to have a lengthwise axis and a width axis, is connected to the grip 60 to be movable relative thereto about an axis perpendicular to the lengthwise axis. The shaving head 100 carries four differently configured cutters, namely, a semi-cylindrical first outer cutter 10, a semi-cylindrical second outer cutter 20, a semi-cylindrical finishing cutter 30, and a slit cutter 40. These cutters are all elongated along the lengthwise axis of the shaving head 100 and arranged in parallel relation with each other along the width axis.

Figure 5:
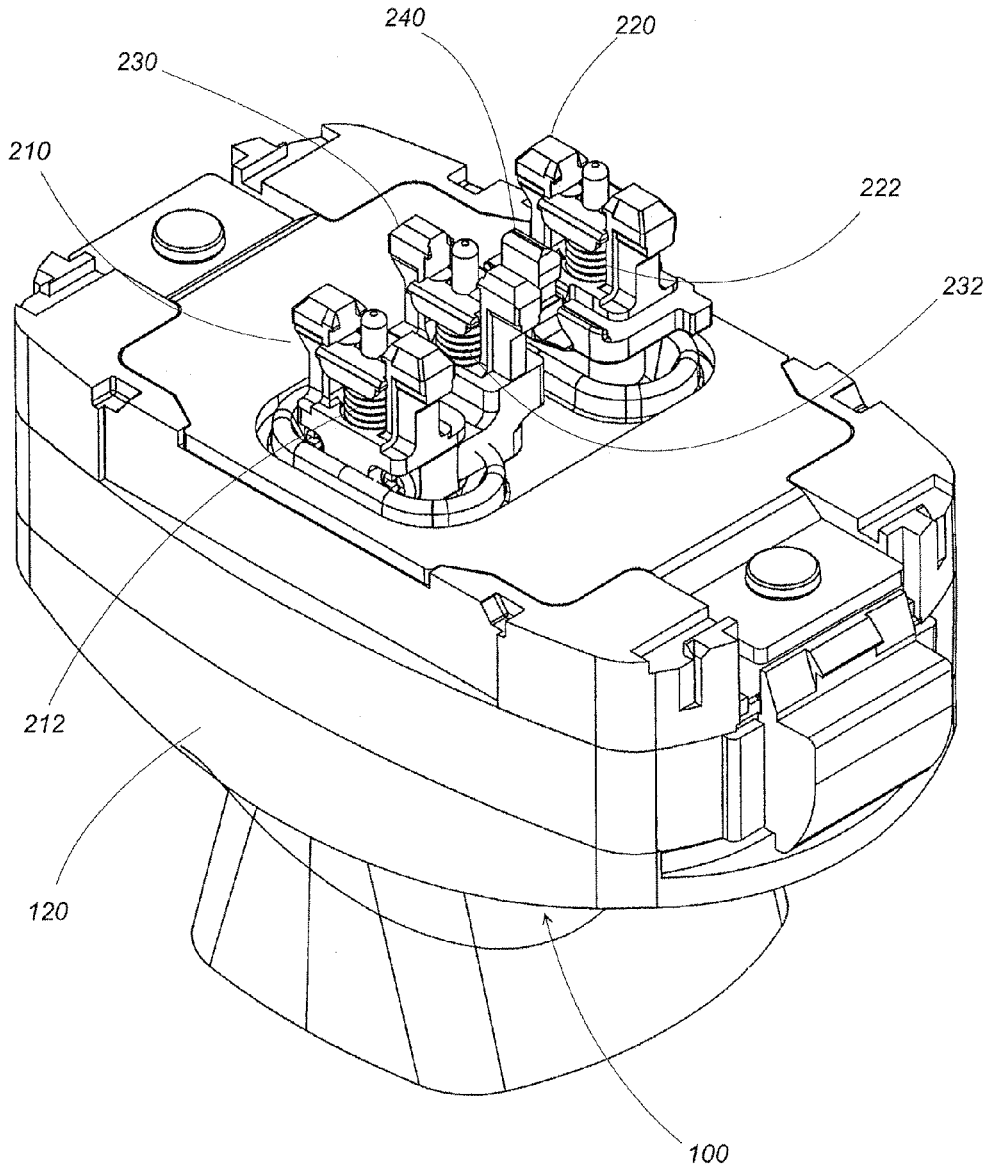
FIG. 5 is a portion of the above shaving head.

The shaving head 100 is composed of a casing 120 and a frame 130 detachable to the casing 120. The casing 120 is of a water-proof structure accommodating therein a linear motor 150 and is provided with a plurality of driving elements 210, 220, 230, and 240 projecting on top of the casing 120, as shown in FIG. 5. These driving elements are connected to the linear motor 150 to be driven thereby to reciprocate along the lengthwise axis of the shaving head 100. The first and second outer cutters 10 and 20 are disposed on the opposite width ends of the shaving head 100, with the finishing cutter 30 and the slit cutter 40 interposed therebetween. The grip 60 is provided with a trimmer 80 on its rear width end further away from the first cutter 10 than from the second cutter 20.

Each of the first and second outer cutters 10 and 20, as well as the finishing cutter 30 includes the shaving foil which is arcuately curved about an axis parallel to the lengthwise axis into an arcuate or semi-cylindrical contour having a width perpendicular to the lengthwise axis. The shaving foil of the first and the second outer cutters 10 and 20 are of the same dimensions and referred hereinafter to as main foils 11 and 21, while the shaving foil of the finishing cutter 30 is configured to have a reduced-width and referred hereinafter to as a finishing foil 31. As will be discussed later, the feature of the shaving foil is explained with regard to the finishing foil 31. However, the same feature may be equally applicable to the main foils 11 and 21 of the first and second outer cutters 10 and 20.

Figure 4:
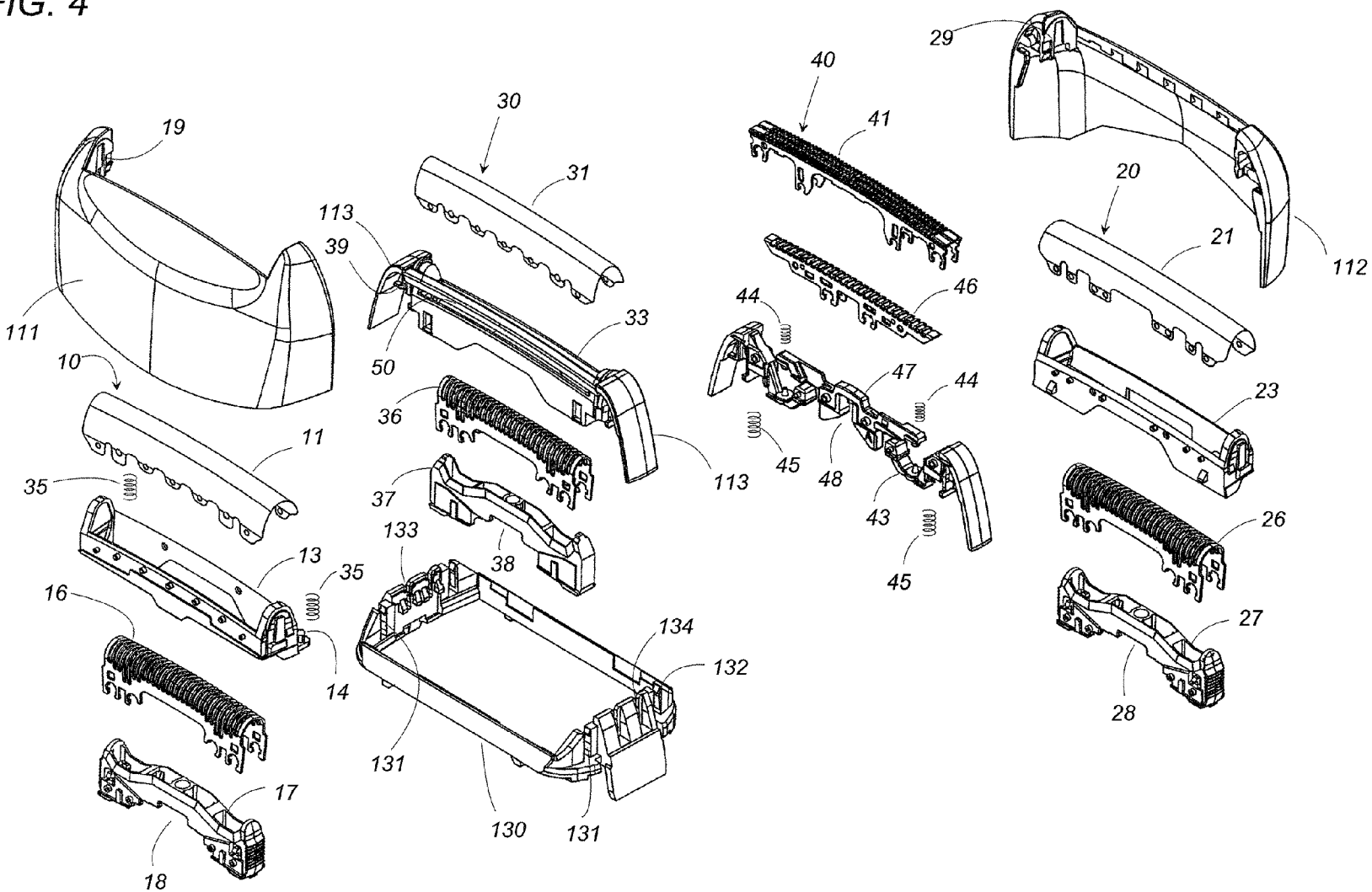
FIG. 4 is an exploded perspective view of the above shaving head.

The first and second outer cutters 10 and 20 are each composed of the main foil 11 and 21, and an inner cutter 16 and 26 which are driven by the linear motor 150 to reciprocate in hair shearing engagement with the main foil. The main foil is formed with a plurality of perforations, and is arcuately curved about an axis parallel to the lengthwise axis of the shaving head 100 into an arcuate contour, i.e., semi-cylindrical shape having a width with respect to the with axis of the shaving head. The first and second outer cutters 10 and 20 are configured to have the main cutters of identical configurations, i.e., the same width and the same radius of curvature, as well as the inner cutters of identical configurations. As best shown in FIG. 4, the main foil 11 (21) is secured at its opposite lateral ends to a mount 13 (23), while the associated inner cutter 16 (26) is secured to a base 17 (27). The mount 13 (23) is floatingly supported to the frame 130 to be movable relative to the frame, and therefore to the casing 120. The bases 17 and 27 are formed in their bottom respectively with catches 18 and 28 which detachably receive the driving elements 210 and 220 for reciprocating the inner cutters 16 and 26. Each of the driving elements 210 and 220 carries a biasing spring 212 and 222 which gives a spring bias SB212 (SB2222) urging the inner cutter and the associated main foil upwardly such that the first and second outer cutter 10 and 20 are capable of being depressed upon being pressed against a user's skin. The mounts 13 and 23 are secured respectively to a front cover 111 and a rear cover 112 which constitute a front wall and a rear wall of the shaving head 100. The front cover 111 is provided at its lengthwise ends with studs 19 which are slidably engaged into corresponding vertical grooves 131 in the frame 130. Likewise, the rear cover 112 is provided at its lengthwise ends with studs 29 which are slidably engaged into corresponding vertical grooves 132 in the frame 130.

Figure 3:
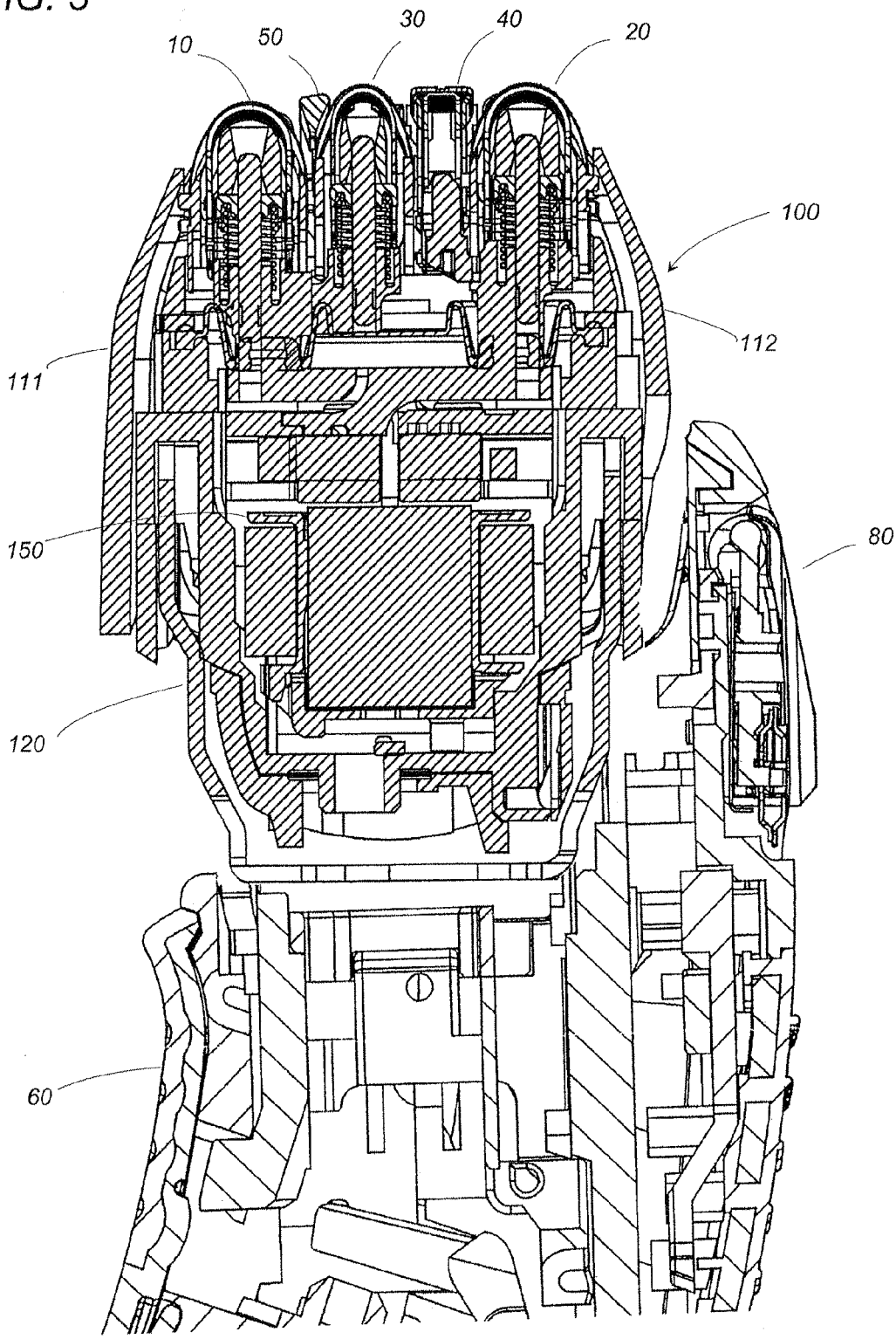
FIG. 3 is a sectional view of the above shaving head.
Figure 6:
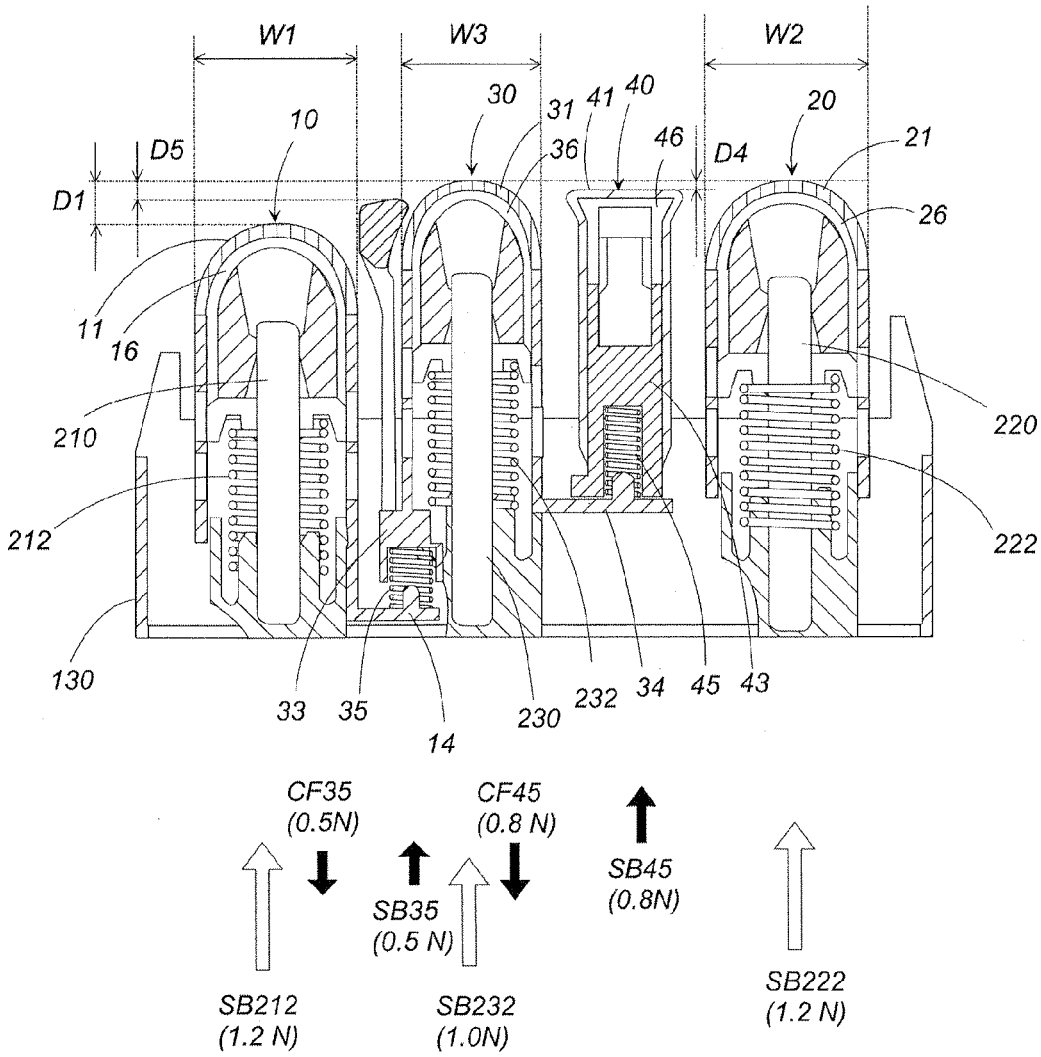
FIG. 6 is a diagram illustrating relationship between four cutters carried on the above shaving head.

The finishing cutter 30 is introduced in the shaving head 110 in order to make making a closer shaving than the first and second cutters 10 and 20, and is composed of the finishing foil 31 and an inner cutter 36 detachably connected to the reciprocating driving element 230 to be driven thereby to reciprocate in hair shearing engagement with the finishing foil 31. The finishing foil 31 is formed with a plurality of perforations 32 and is arcuately curved about an axis parallel to the lengthwise axis of the shaving head 100 into an arcuate contour, i.e., semi-cylindrical shape having a width along the width axis of the shaving head. As best shown in FIGS. 3 and 6, the finishing foil 31 is deeply curved to have a radius of curvature smaller than that of the main foils 11 and 21, and therefore the width W3 smaller than those W1 and W2 of the main foils, thereby increasing a chance of capturing hairs deep into the perforations, particularly around a tip of the finishing foil 31 for cutting the hairs shorter than expected at the first and second cutters 10 and 20, i.e., finishing the hairs to minimum length. As shown in FIG. 4, the finishing foil 31 is secured at its opposite lateral ends to a mount 33, while the inner cutter 36 is fixed to a base 37. The base 37 is formed in its bottom with a catch 38 which detachably receives the driving element 230 for reciprocating the inner cutter 36. The mount 33 is floatingly supported to the frame 130 to be movable relative to the casing 120 of the shaving head 100. The mount 33 is formed integrally with a skin guard 50 which projects between the first outer cutter 10 and the finishing cutter 30 and is movable together with the finishing foil 31 relative to the casing 120. The skin guard 50 extends in parallel and in closely adjacent relation to the side of the finishing foil 31. The mount 33 is formed at its opposite lengthwise ends with side covers 113 which constitute portion of side walls of the shaving head 100. The driving element 230 carries a spring 232 which gives a spring bias SB232 urging the inner cutter against the finishing foil 31 and therefore the finishing cutter 31 upwardly such that the finishing cutter 31 is capable of being depressed upon being pressed against the user's skin. The mount 33 is also formed at its opposite lengthwise ends with studs 39 which are held slidable in corresponding grooves 133 in the frame 130 so that the finishing cutter 30 is movable relative to the frame 130 as being biased upwardly by the spring 232.

Figure 8:
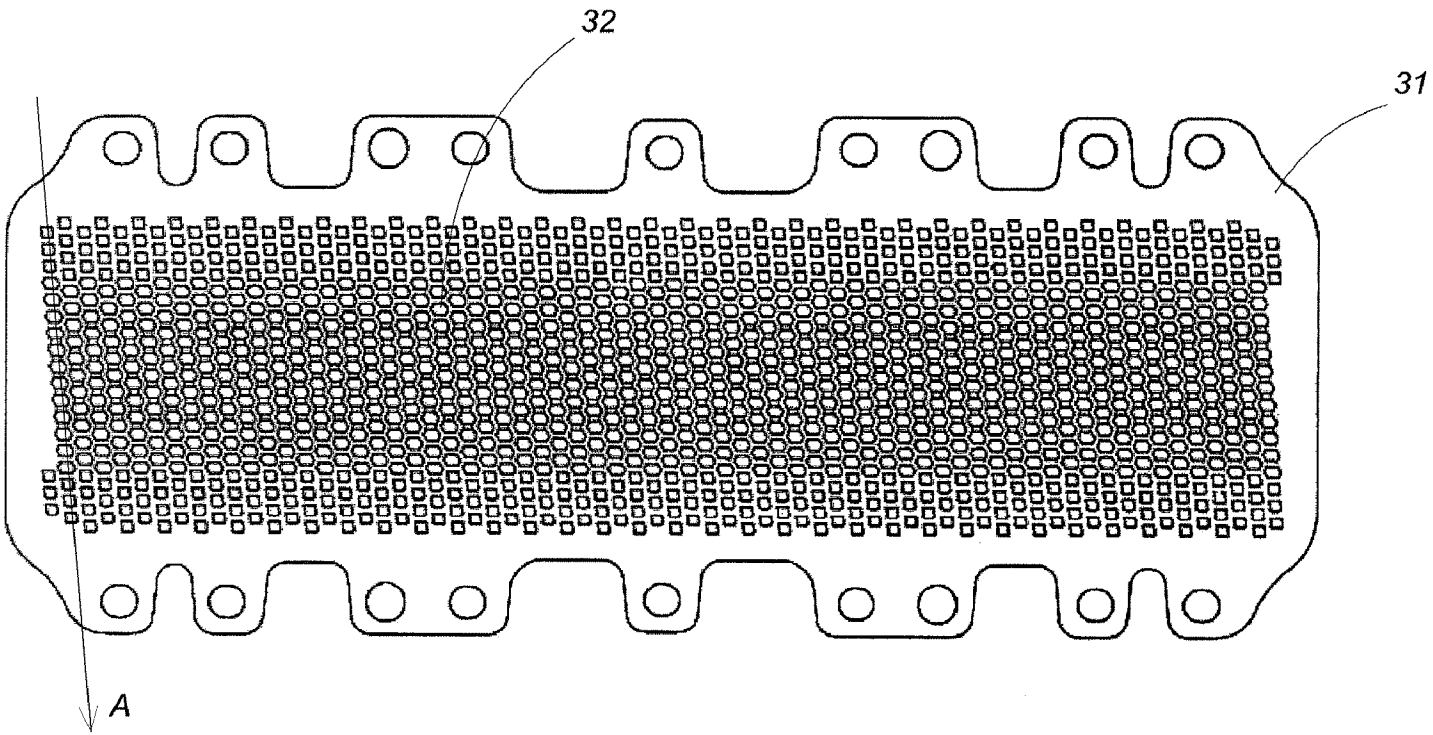
FIG. 8 is a plan view of a finishing foil forming a finishing cutter, one of the above four cutters.
Figure 9:
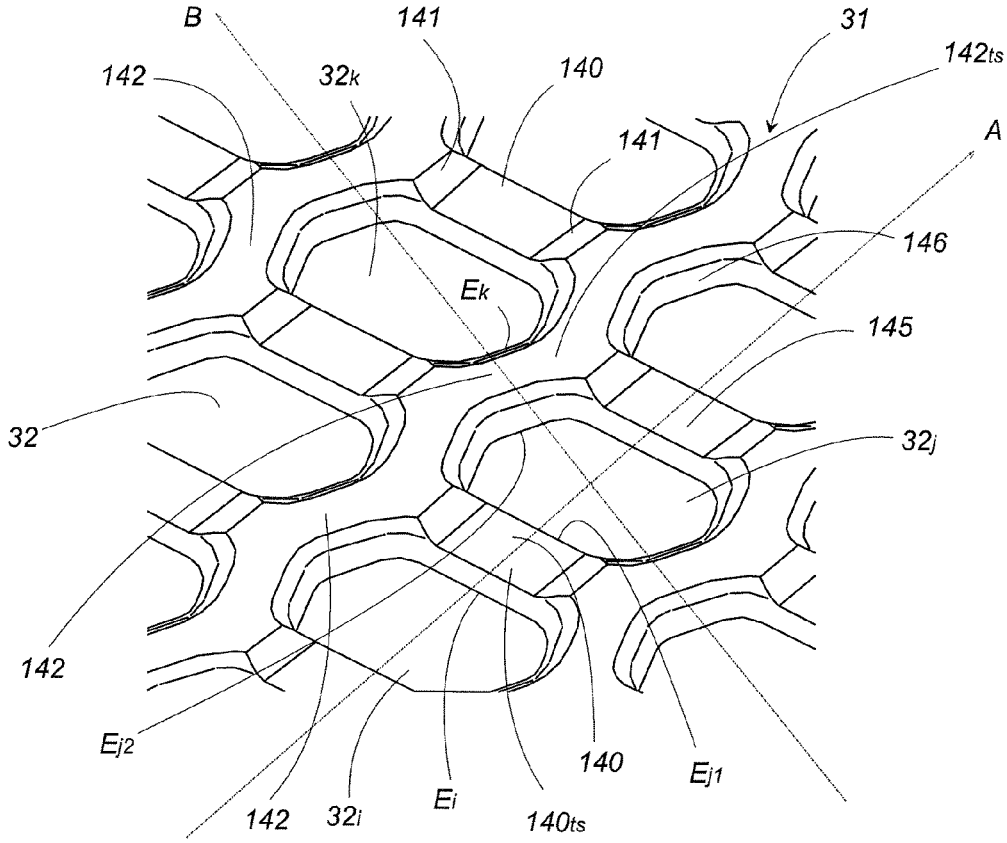
FIG. 9 is a perspective view of the above finishing foil.

Referring to FIGS. 8 and 9, the finishing foil 31 are now explained in details with respect to its structural feature. The perforations 32 are arranged in an array composed of rows aligned with a length of the foil and columns aligned along a direction slightly inclined with respect to a width direction of the foil. As shown in FIG. 9, the foil 31 is formed in its top surface with a plurality of recesses 140 arranged along each column in an alternating relation with the perforations 32 to define plural series of thin sections 140 of reduced thickness, leaving the other portions as thick sections 142 which continuously extends over the full width of the foil 31 between the adjacent columns of the perforations 32. With this result, each of the perforations 32 has its circumference partly defined by the thin sections 140 and partly by the thick sections 142. Since the thin sections 140 alternate with the perforations 32 along the column, the hairs are guided along a series of the thin sections 140 as the shaving head 100 is moved across the skin with the cutter being oriented to have its width in generally perpendicular to the moving direction, during which the flattened hairs can be easily guided into the perforations through the thin sections and are raised at the edge of the perforation 32 adjacent the thin section 140 for successfully cutting the flattened hairs. On the other hand, the thick sections 142 provide flat faces which extend continuously along the columns, or the width direction of the foil 31 to give a smooth skin contact for facilitating the shaving, while retaining the effect of raising and cutting the flattened hairs by provision of the thin sections 140. For instance, the thick section is selected to have a thickness of 50 μm to 80 μm, while the thin section 140 has a thickness of 45 μm or less.

As shown in FIG. 9, each of the perforations 32 are shaped into a hexagon having an opposed pair of long sides and two opposed pairs of short sides. The thin sections 140 merge into the long sides, while the thick sections 142 merges into the short sides. That is, each perforation 32 is surrounded at its long sides by the thin sections 140 and at its short sides surrounded by the thick sections 142. The thin section 140 has its top surface connected to the top surface of the thick sections 142 by way of inclined shoulder 141. The hexagon is dimensioned, for example, to have a length of 0.5 mm in the row direction, and a width of 0.3 mm in the column direction.

Figure 10:
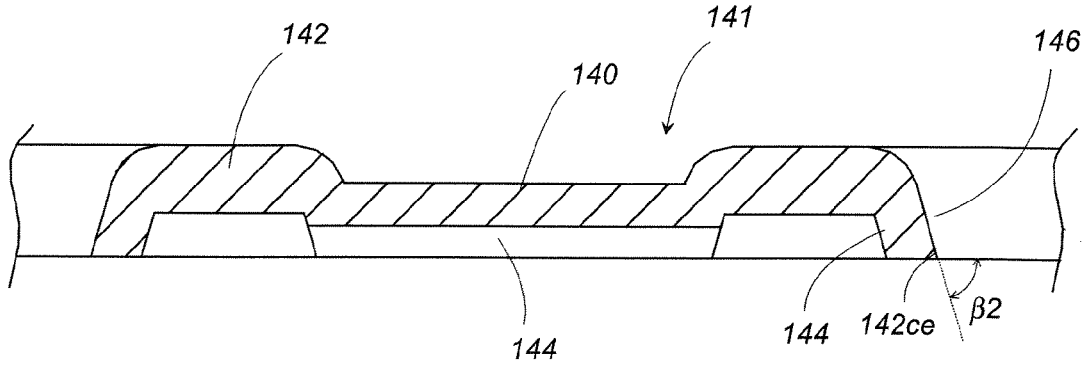
FIG. 10 is a cross-section of a part of the above finishing foil along one direction.
Figure 11:
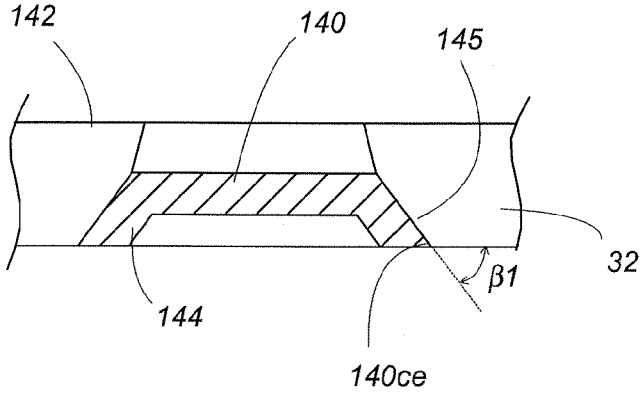
FIG. 11 is a cross-section of a part of the above finishing foil along another direction.

As shown in FIGS. 10 and 11, each perforation 32 is surrounded by a raised rim 144 which projects on bottom of the foil 31, and is shaped to have inclined edges 145 and 146, respectively leading from the long sides and short sides. The inclined edge 145 extends continuously from the thin section 140 is given at its lower end a cutting angle of β1 smaller than the cutting angle of β2 at the lower end of the inclined edge 146. The smaller cutting angle of β1 is found advantageous to enhance the effect of raising the flattened hairs guided by the thin sections 140. Further, the finishing foil 31 is configured to include the thick sections 142 which occupy a larger area than the thin section 140, in order to give sufficient mechanical strength and assure the smooth skin contact.

The main foils 11 and 21 of the first outer cutter 10 and the second outer cutter 20 may be selected to have the like configuration including the thin sections and the thick section, or to be devoid of the thin sections.

Figure 12:
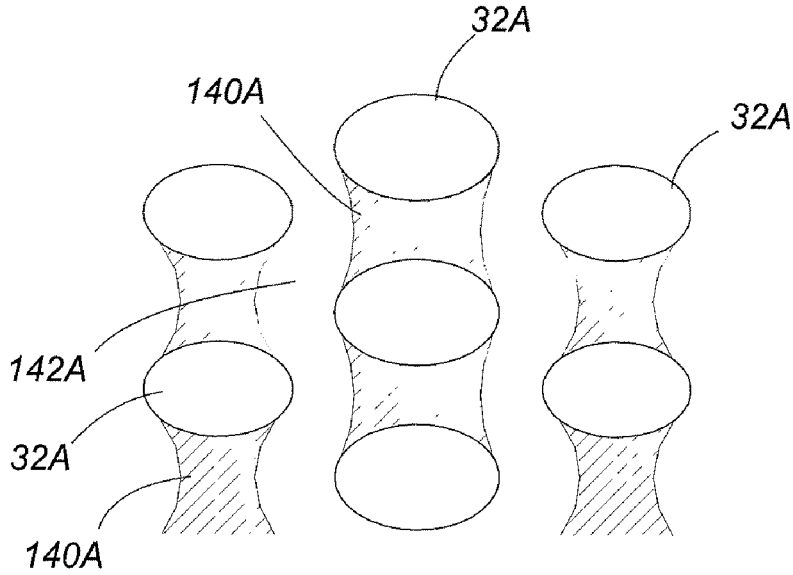
FIG. 12 is a schematic view illustrating a modification of the finishing foil.

Further, as shown in FIG. 12, the finishing foil 31A may be configured to have the ellipsoidal perforations 32A arranged in an array with major axes of the perforations being aligned with the length of the foil. In this instance, the thin sections 140A alternate with the perforations 32A in the column direction, and the thick sections 142A extend continuously in the column direction.

Figure 13:
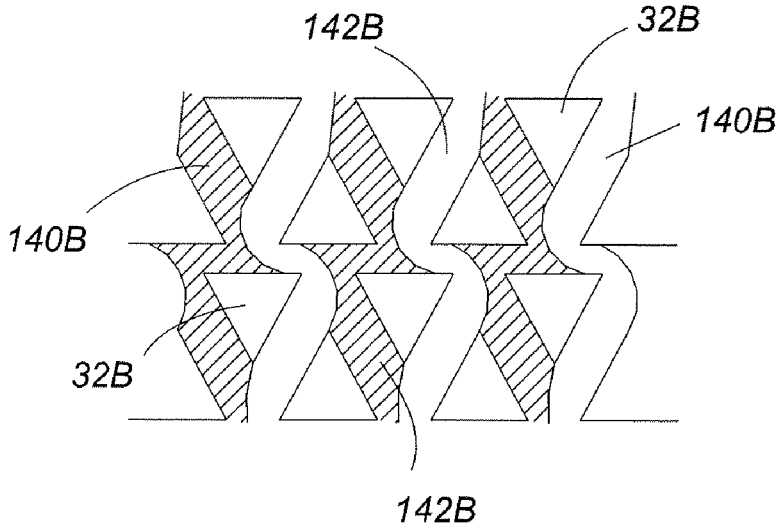
FIG. 13 is a schematic view illustrating another modification of the finishing foil.

FIG. 13 shows a further modification of the finishing foil 31B in which triangular perforations 32B are arranged in an array. The perforations 32B in each column have its apex oriented towards one width end of the foil along the column direction, but oriented oppositely to the perforations in the adjacent column, and are also staggered with respect to the perforations in the adjacent column. The thin section 140B extends continuously in the width direction in such a manner as to merge one oblique side of each triangular perforation 32B and also the adjacent bottom thereof, while the thick section 142B extends continuously in the width direction in such a manner as to merge into the other oblique side of each triangular perforation 32B.

The slit cutter 40 is composed of an elongated outer blade 41 with a number of slits opened at lateral edges of the outer blade 41, and an inner cutter 46 driven to reciprocate in hair shearing engagement with the outer blade 41. The outer blade 41 is shaped to have a generally flat top surface for sliding contact with the user's skin to capture flattened hairs into the slits for cutting the hairs. The outer blade 41 is fixed to a mount 43 which is floatingly supported to the frame 130. The inner cutter 46 is secured to a base 47 which is slidably held on the mount 43 to reciprocate the inner cutter 46 relative to the outer blade 41. Springs 44 are interposed between the mount 43 and the base 47 to keep the inner cutter 46 pressed against the outer blade 41. The frame 43 is formed at its opposite lengthwise ends with studs 49 which are slidably engaged into corresponding grooves 134 in the frame 130 for floatingly support the slit cutter 40 to the frame 130. The base 47 is formed in its bottom with a catch 48 which detachably receives the driving element 240 for reciprocating the inner cutter 46. As shown in FIG. 5, the driving element 240 is integrally formed with the driving element 220 but gives no bias to the slit cutter 40. Instead, springs 45 are interposed between the frame 43 and extensions 34 extending from the mount 33 of the finishing cutter 30 to give a sprig bias SB45 urging the slit cutter 40 upwardly.

Figure 7:
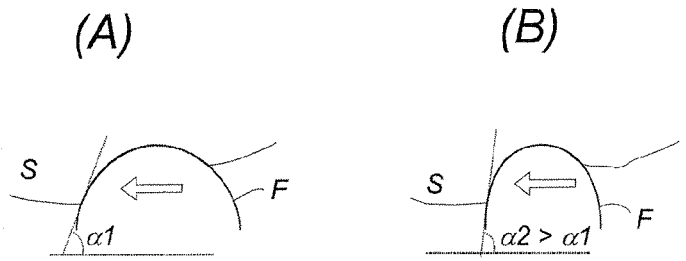
FIG. 7 is a schematic view illustrating a manner in which a moving arcuate foil contacts with a skin.
Figure 14:
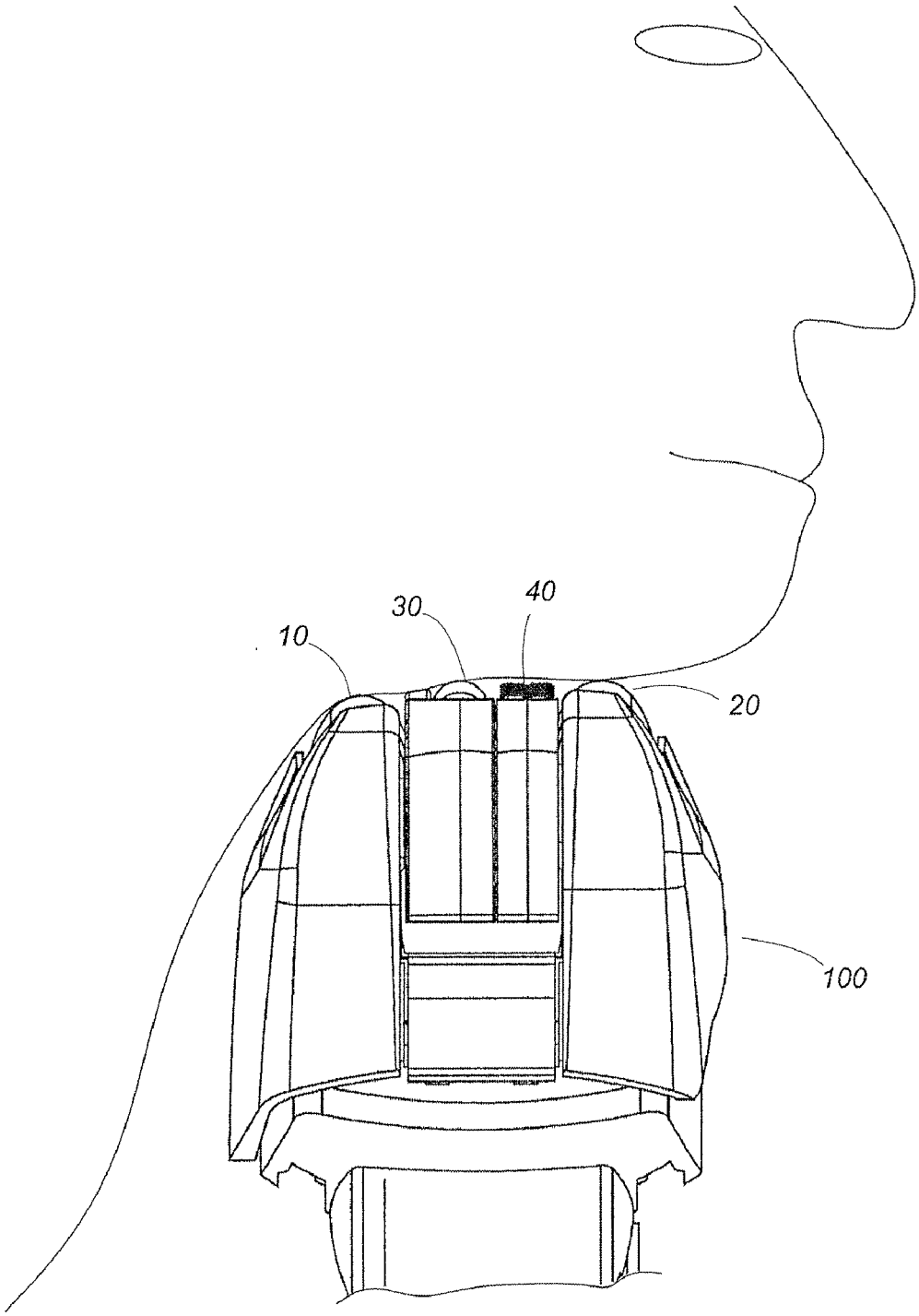
FIGS. 14 and 15 are schematic view illustrating operations of the above shaver.
Figure 15:
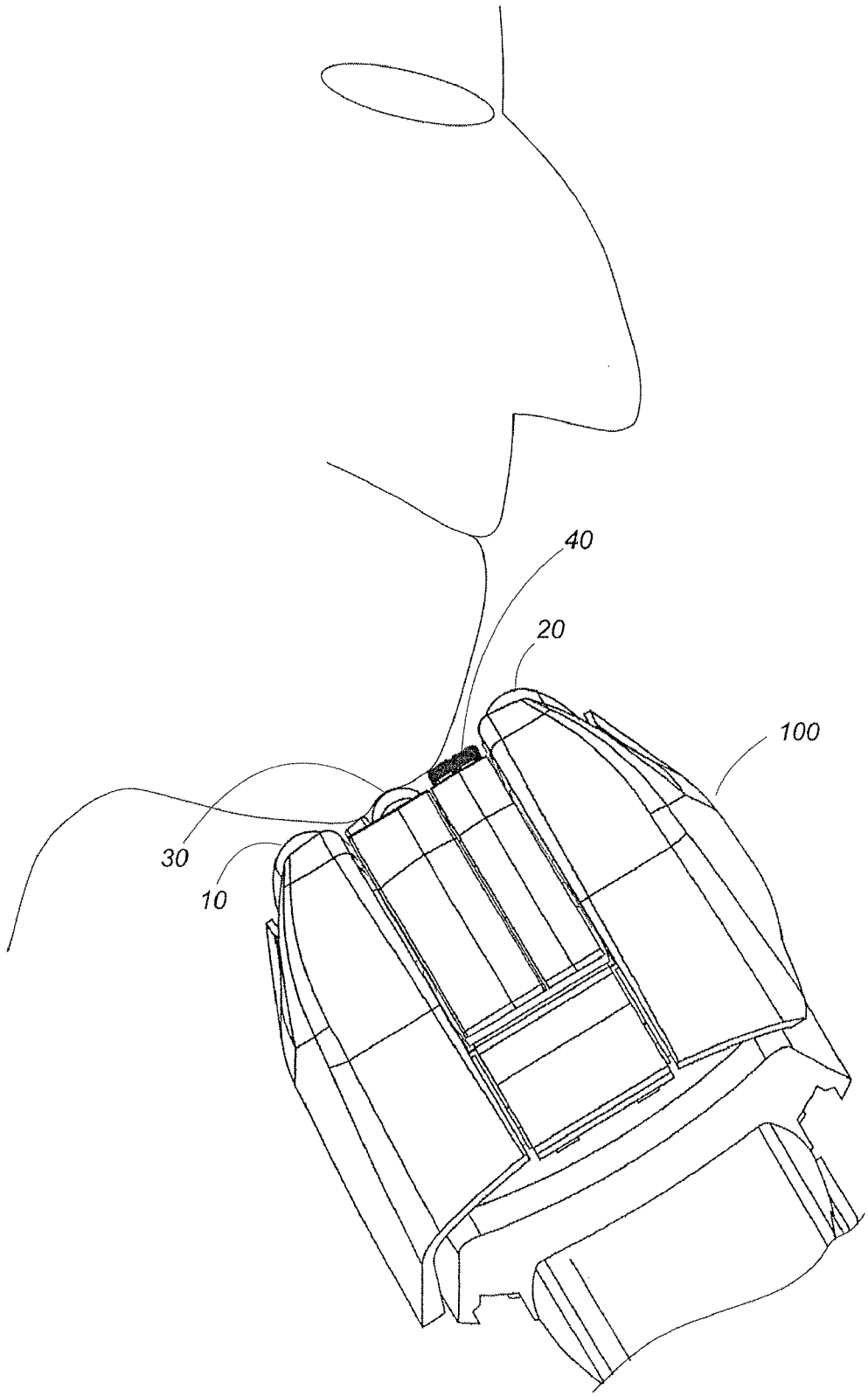

FIG. 6 shows a height relationship among the four cutters in a free condition of not being depressed or not being held in pressed contact with the user's skin. The second cutter 20 and the finishing cutter 30 are disposed to have their tips at the same level, while the first cutter 10 has its tip lowered by a large difference D1 from that of the finishing cutter 30, and the slit cutter 40 has its tip lowered by a small difference D4 from that of the finishing cutter 30. The skin guard 50 which is movable together with the finishing cutter 30 has its tip disposed at a level higher that that of the first cutter 10 but is lower than that of the finishing cutter 30 by a difference of D5. With this multi-cutter arrangement, each cutter can be held in an optimum contact with the user's skin for effective shaving. For example, when shaving hairs under the chin, as shown in FIG. 14, with the first cutter 10 ahead in the moving direction, the cutters are simultaneously held in contact with the skin to make the individual shaving effectively. On the other hand, when shaving a narrow area such as a chin top, as shown in FIG. 15, the finishing cutter 30 can be pressed against the skin in combination with the skin guard 50 and the slit cutter 40 so as to cut the hairs to minimum. In this connection, it is noted that as a result of being deeply curved, the finishing foil 31 is given an effective cutting zone only around its tip and leave ineffective zones respectively on its opposite sides where the skin is likely to cause skin irritation when being pressed hard against the skin. That is, as shown in FIGS. 7(A) and (B), as the foil F is curved deeper, the foil is caused to be pressed against at a greater angle (α1, α2) of contact on its leading side with respect to a direction of moving the shaving head, and is therefore pressed at a greater force against the skin S, which eventually increases a chance of capturing the skin deep through the perforations in the foil, and accordingly irritating the skin. In this sense, the lower portion on the side of the deeply curved finishing cutter 30 is not suitable for pleasant shaving in a situation when the shaving head is moving around the skin with the finishing cutter being pressed at its leading side against the skin, while the upper portion of the side of the finishing cutter is effectively utilized for cutting the hairs minimum.

In order to avoid the skin from contacting the lower portion of the side of the finishing cutter, i.e., ineffective zone, the skin guard 50 is positioned to cover ineffective zone in closely adjacent relation thereto with its top slightly lowered from the tip of the finishing cutter 30, for the purpose of exposing the effective zone, i.e., the upper portion of the finishing cutter 30 around its tip for close shaving. In this connection, the skin guard 50 is offset towards the finishing cutter 30 so as not to interfere with the shaving operation of the first outer cutter 10. The slit cutter 40 also act as another skin guard in a sense of avoiding the skin from contacting with the lower side portion of the finishing cutter 30 and minimizing the skin irritation, when the shaving head 100 is moving with the second outer cutter 20 leading in the direction of movement.

Turning back to FIG. 6, the finishing foil 31 is urged upwardly also by adjustor springs 35 interposed between the frame 33 of the finishing foil 31 and projections 14 extending from the frame 13 of the first outer cutter 10 such that the finishing foil 31 receives an upward spring-bias which is a combination of the upward spring bias SB232 from the spring 232 of the driving element 230, and an upward additional spring bias SB35 by the adjustor spring 35, and the downward spring bias CF45, which is a counter-force of the springs 45 urging the slit cutter 40 upwardly. The adjustor springs 35 develop a counter-force CF35 which urges the main foil 11 of the first outer cutter 10 downwards such that the first outer cutter 10 receives an upward spring bias, a combination of the upward spring bias SB212 from the spring 212 of the driving element 210 and the downward bias CF35 of the adjustor springs 35. Thus, as schematically illustrated by corresponding arrows in FIG. 6, the individual cutters are given optimum spring bias by use of the adjustor springs 35 and 45. Particularly, the first outer cutter 10 and the second outer cutter 20 can be given different spring biases, while using the driving elements 210 and 220 of the same configuration, i.e., the springs 212 and 222 of the same spring forces. For example, when the driving elements 210, 230, and 220 are selected to have spring biases SB212, SB232, and SB222 respectively of 1.2 N, 1.0 N, and 1.2 N, in combination with the adjustor springs 35 having the spring force of 0.5 N, and the springs 45 having the spring force of 0.8N, the first outer cutter 10, the finishing cutter 30, the slit cutter 40, and the second outer cutter 20 are given the spring biases of 0.7 N (=1.2 N−0.5 N), 0.7 N (=1.0 N+0.5 N−0.8N), 0.8 N, and 1.2N, respectively.

In the illustrated embodiment, each of the cutters 10, 20, 30, and 40 as well as the skin guard 50 are slightly curved arcuately with respect to the lengthwise axis for smooth contact with the skin. However, the present invention should not be interpreted to be limited thereto and may equally encompass the arrangement in which at least one of the cutters and the skin guard is configured to have straight top surface with respect to the lengthwise direction.

The invention claimed is:

1. A shaving foil for a dry shaver, said foil having an array of perforations and being formed with a plurality of recesses formed in its top surface defining a skin contact surface to give a thin section of reduced thickness at each of said recesses and to leave a thick section at the remainder of said foil, wherein each of said perforations is configured to have its circumference defined partly by said thin section and partly by said thick section, wherein said array is configured to include first adjacent pairs of the perforations arranged in a first direction, and second adjacent pairs of said perforations arranged in a second direction different from said first direction, wherein said thin section is configured to extend between the perforations of said first adjacent pairs to have its top surface leading to the peripheries of the perforations at opposite ends of said thin section with respect to said first direction, wherein said thick section is configured to extend between the perforations of said second adjacent pairs to have its top surface leading to the peripheries of the perforations at opposite ends of the thick section with respect to said second direction.

2. A shaving foil as set forth in claim 1, wherein said thick section is configured to extend over two or more successive perforations arranged in said first direction.

3. A shaving foil as set forth in claim 1, wherein said thin section and said thick section are configured to extend to associated portions of the periphery of the perforation to form thereat a first cutting edge and a second cutting edge, respectively, said first cutting edge having a cutting angle less than that of said second cutting edge.

4. A shaving foil as set forth in claim 1, wherein said foil is elongated to have a lengthwise axis, said thin sections are arranged along said first direction which crosses with said lengthwise axis.

5. A shaving foil as set forth in claim 4, wherein said thick section is configured to extend continuously over a full width of said foil along said first direction.

6. A shaving foil as set forth in claim 5, wherein said foil is configured such that said thin sections occupy a less area than said thick sections.

7. A shaving foil as set forth in claim 1, wherein each of said perforations is shaped into a polygon having one side bridged to one of the adjacent perforations through said thin section, and another side bridged to another of adjacent perforations by means of said thick section.

8. A shaving foil as set forth in claim 1, wherein said thick section has a thickness of 50 μm to 80 μm said thin section has a thickness of 45 μm or less.

* * * * *